US011520294B2

(12) United States Patent
Nakamura et al.

(10) Patent No.: US 11,520,294 B2
(45) Date of Patent: Dec. 6, 2022

(54) COMPONENT FOR TIMEPIECE, MOVEMENT, AND TIMEPIECE

(71) Applicant: Seiko Instruments Inc., Chiba (JP)

(72) Inventors: Takahiko Nakamura, Chiba (JP); Natsuki Ebihara, Chiba (JP)

(73) Assignee: Seiko Instruments Inc., Chiba (JP)

( * ) Notice: Subject to any disclaimer, the term of this patent is extended or adjusted under 35 U.S.C. 154(b) by 946 days.

(21) Appl. No.: 16/292,868

(22) Filed: Mar. 5, 2019

(65) Prior Publication Data

US 2019/0278228 A1 Sep. 12, 2019

(30) Foreign Application Priority Data

Mar. 9, 2018 (JP) ..... JP2018-043194

(51) Int. Cl.
*G04B 31/08* (2006.01)
*G04B 15/14* (2006.01)

(52) U.S. Cl.
CPC ..... *G04B 31/08* (2013.01); *G04B 15/14* (2013.01)

(58) Field of Classification Search
CPC ..... G04B 31/08; G04B 15/14
See application file for complete search history.

(56) References Cited

U.S. PATENT DOCUMENTS 5,346,633 A 9/1994 Nakakawaji et al.
2018/0231938 A1* 8/2018 Nakamura ..... C09D 4/00

FOREIGN PATENT DOCUMENTS

CN 1957047 A 5/2007
JP 2001-288452 A 10/2001
JP 4545405 B2 9/2010

OTHER PUBLICATIONS

Machine Translation of CN 1957047 (Year: 2022).*
Office Action in CN Application No. 201910148982.1, English translation, dated Apr. 19, 2021, 6 pages.

* cited by examiner

*Primary Examiner* — Edwin A. Leon
*Assistant Examiner* — Jason M Collins
(74) *Attorney, Agent, or Firm* — Crowell & Moring LLP

(57) ABSTRACT

There are provided a component for a timepiece, a movement, and a timepiece having excellent lubricating oil holding performance. There is provided a component for a timepiece including a sliding surface having a surface tension of 10 to 35 mN/m. It is preferable that when lubricating oil having a surface tension of 25 to 35 mN/m is applied to the sliding surface, an interfacial tension between the sliding surface and the lubricating oil is 0 to 7 mN/m.

5 Claims, 5 Drawing Sheets

COMPONENT FOR TIMEPIECE, MOVEMENT, AND TIMEPIECE

RELATED APPLICATIONS

This application claims priority under 35 U.S.C. § 119 to Japanese Patent Application No. 2018-043194 filed on Mar. 9, 2018, the entire content of which is hereby incorporated by reference.

BACKGROUND OF THE INVENTION

1. Field of the Invention

The present invention relates to a component for a timepiece, a movement, and a timepiece.

2. Description of Related Art

A driving force is applied continuously or intermittently to a component for a timepiece used in a timepiece, such as an escape wheel & pinion and a pallet fork. Therefore, in order to reduce friction due to sliding during rotation and the like, it is required to hold lubricating oil at a sliding location of the component for a timepiece.

JP-A-2001-288452 (Patent Reference 1) discloses a technology of forming an oil repellent film which is out of a region where the lubricating oil is held to hold the lubricating oil in the region.

However, since the component for a timepiece is small, it was difficult to form the oil repellent film only in a specific region, and it was not easy to employ the technology described in Patent Reference 1.

Here, Japanese Patent No. 4545405 (Patent Reference 2) discloses a technology of forming an oil repellent film on the entire component for a timepiece to hold the lubricating oil at a lubrication location.

However, it was not possible to say that the component for a timepiece described in Patent Reference 2 has a sufficient function of holding the lubricating oil. Therefore, there was a case where abrasion of the component for a timepiece occurred due to a lack of the lubricating oil.

In addition, in a case where a concentration of a treatment agent for forming the oil repellent film is low, there was a case where a part to which surface treatment is not performed occurs. As a result, there was a case where the lubricating oil spread wet and abrasion of the component for a timepiece occurred due to the lack of the lubricating oil due to transpiration.

SUMMARY OF THE INVENTION

It is an aspect of the present application to provide a component for a timepiece, a movement, and a timepiece having excellent lubricating oil holding performance.

It is another aspect of the present application to provide a component for a timepiece including a sliding surface having a surface tension of 10 to 35 mN/m.

According to the configuration, since affinity with the lubricating oil increases, the lubricating oil is unlikely to flow out from the sliding surface. Accordingly, since a state where the lubricating oil exists on the sliding surface is maintained, it becomes possible to suppress deterioration of the component for a timepiece due to the abrasion or the like, and to perform a stable operation for a long period of time.

It is preferable that, when the lubricating oil having a surface tension of 25 to 35 mN/m is applied to the sliding surface, an interfacial tension between the sliding surface and the lubricating oil is 0 to 7 mN/m.

According to the configuration, the lubricating oil is more unlikely to flow out from the sliding surface. Accordingly, it is possible to further enhance the oil holding performance.

It is another aspect of the present application to provide a movement including the component for a timepiece.

According to the configuration, since the component for a timepiece is provided, it becomes possible to perform a stable operation for a long period of time, and to enhance reliability.

It is another aspect of the present application to provide a timepiece including the movement.

According to the configuration, since the component for a timepiece is provided, it becomes possible to perform a stable operation for a long period of time, and to enhance reliability.

According to the present application, high oil holding performance against lubricating oil is exhibited.

DESCRIPTION OF EMBODIMENTS

Figure 1:
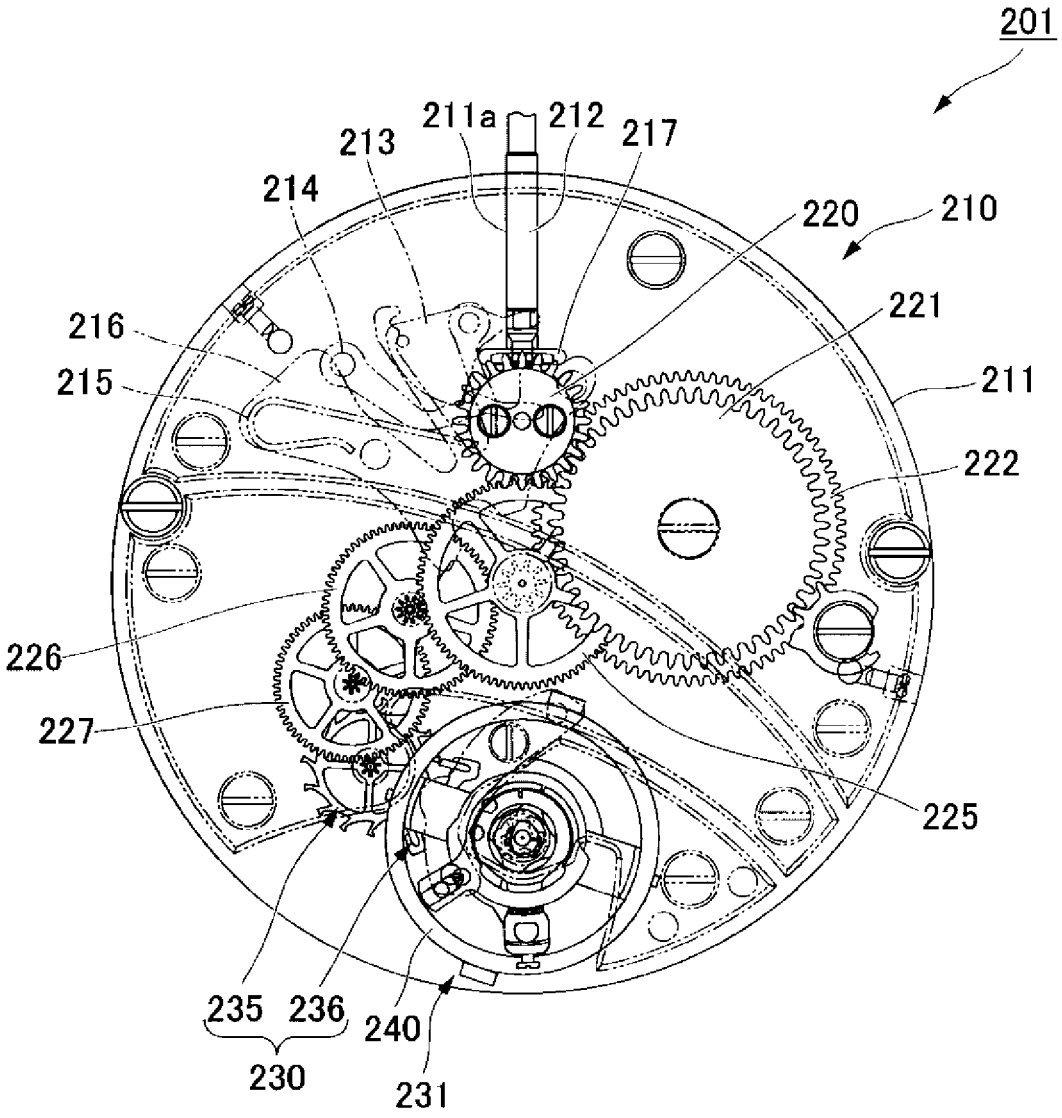
FIG. 1 is a plan view illustrating one aspect of a front side of a movement included in a component for a timepiece according to a first embodiment of the present invention.

Embodiments of the present invention will be described with reference to the drawings.

In addition, in the following description, the same reference numerals will be given to configurations having the same or similar functions. In addition, there is a case where overlapping description of the configurations is omitted.

In addition, in each of the following drawings, in order to make it easy to see the drawing, there is a case where a part of a component for a timepiece and a movement is omitted and the component for a timepiece and the movement are illustrated in a simplified manner.

First Embodiment

A movement and a timepiece including a component for a timepiece according to a first embodiment of the present invention will be described with reference to FIG. 1.

In general, a mechanical body including a driving part of the timepiece is called a "movement". A state where a dial and a needle are attached to the movement, put in a timepiece case, and made into a finished product is called a "complete" of the timepiece.

FIG. 1 is a plan view of a front side of the movement.

As illustrated in FIG. 1, a mechanical timepiece 201 is configured with a movement 210 and a casing (not illustrated) that houses the movement 210.

The movement 210 has a main plate 211 that configures a board. A dial (not illustrated) is arranged on a rear side of the main plate 211. In addition, a gear train incorporated in the front side of the movement 210 is referred to as a front wheel train and the gear train incorporated in the rear side of the movement 210 is referred to as a rear wheel train.

In the main plate 211, a winding stem guide hole 211*a* is formed, and a winding stem 212 is rotatably incorporated in the winding stem guide hole 211*a*. The position of the winding stem 212 in a shaft direction is determined by a switching device having a setting lever 213, a yoke 214, a yoke spring 215, and a setting lever jumper 216. In addition, a winding pinion 217 is rotatably provided in the guide shaft portion of the winding stem 212.

When the winding stem 212 is rotated in a state where the winding stem 212 is at a first winding stem position (0-th stage) nearest to an inner side of the movement 210 along a rotating shaft direction, the winding pinion 217 rotates via rotation of a clutch wheel (not illustrated). In addition, as the winding pinion 217 rotates, a crown wheel 220 meshing therewith rotates. Further, as the crown wheel 220 rotates, a ratchet wheel 221 meshing therewith rotates. Furthermore, as the ratchet wheel 221 rotates, a mainspring (power source) (not illustrated) accommodated in a movement barrel 222 is rolled up.

The front wheel train of the movement 210 is configured with a second wheel & pinion 225, a third wheel & pinion 226, and a fourth wheel & pinion 227 in addition to the above-described movement barrel 222, and achieves a function of transmitting a rotating force of the movement barrel 222. In addition, on the front side of the movement 210, an escape mechanism 230 and a speed adjustment mechanism 231 for controlling the rotation of the front wheel train are disposed.

The second wheel & pinion 225 is regarded as a wheel meshing with the movement barrel 222. The third wheel & pinion 226 is regarded as a wheel meshing with the second wheel & pinion 225. The fourth wheel & pinion 227 is regarded as a wheel meshing with the third wheel & pinion 226.

The speed adjustment mechanism 231 is a mechanism for adjusting the speed of the escape mechanism 230 and has a balance with a hairspring 240.

The escape mechanism 230 is a mechanism for controlling the rotation of the above-described front wheel train, and includes an escape wheel & pinion 235 meshing with the fourth wheel & pinion 227, and a pallet fork 236 which makes the escape wheel & pinion 235 escape and regularly rotate. The escape mechanism 230 is a component for a timepiece according to the first embodiment of the present invention.

Figure 2:
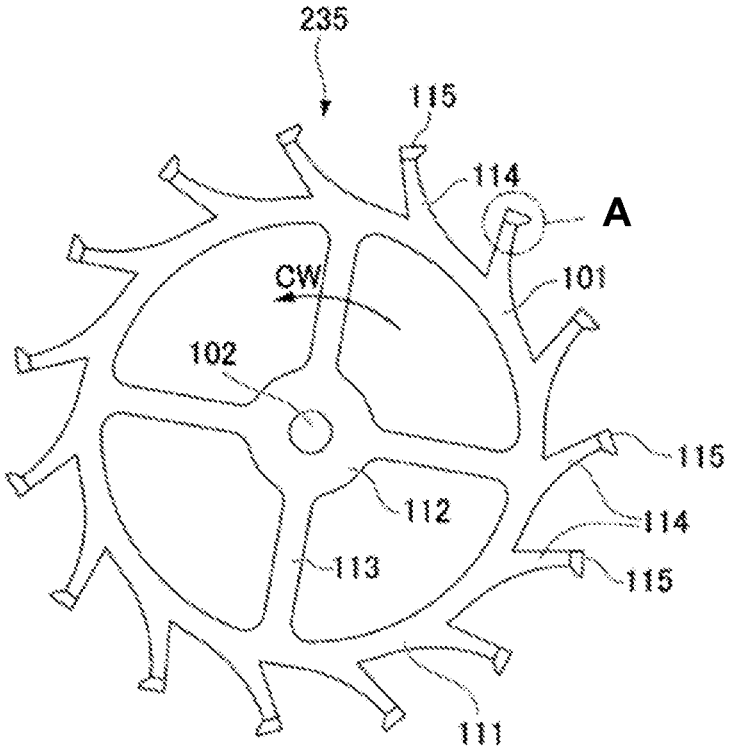
FIG. 2 is a plan view illustrating one aspect of an escape wheel & pinion that configures the component for a timepiece of the first embodiment.
Figure 3:
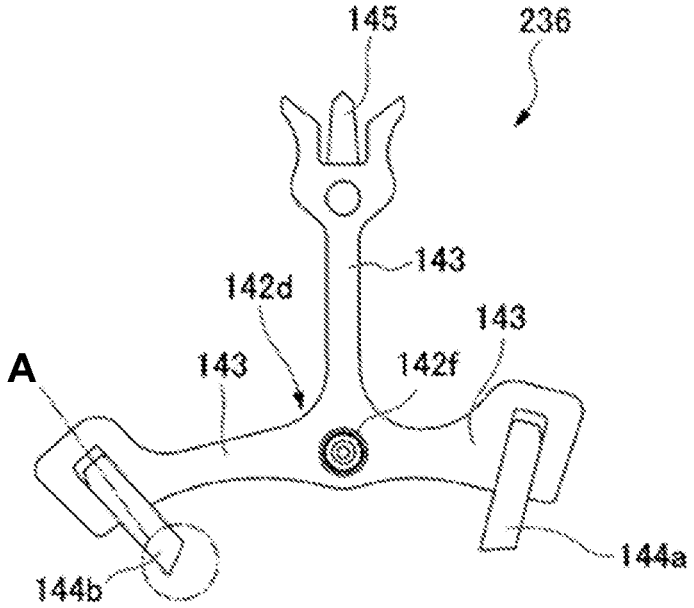
FIG. 3 is a plan view illustrating one aspect of a pallet fork that configures the component for a timepiece of the first embodiment.

FIG. 2 is a plan view of the escape wheel & pinion 235 that configures the escape mechanism 230. FIG. 3 is a plan view of the pallet fork 236 that configures the escape mechanism 230.

(Escape Wheel & Pinion)

As illustrated in FIG. 2, the escape wheel & pinion 235 includes an escape wheel portion 101 and a shaft member 102 coaxially fixed to the escape wheel portion 101. A direction orthogonal to the axial line of the shaft member 102 is referred to as a radial direction. In FIG. 2, a rotational direction of the escape wheel & pinion 235 is indicated by CW.

The escape wheel portion 101 includes an annular rim portion 111, a hub portion 112 disposed on the inner side of the rim portion 111, and a plurality of spoke portions 113 connecting the rim portion 111 and the hub portion 112 to each other. The hub portion 112 has a disc shape, and the shaft member 102 is fixed to the center part thereof by press-fitting or the like. Each of the spoke portions 113 radially extends from an outer circumferential edge of the hub portion 112 toward an inner circumferential edge of the rim portion 111.

On an outer circumferential surface of the rim portion 111, a plurality of special tooth portions 114 formed in a special hook shape protrude outward in the radial direction. Nail stones 144*a* and 144*b* (refer to FIG. 3) of the pallet fork 236 which will be described later mesh with tip end portions of the plurality of tooth portions 114.

Figure 2A:
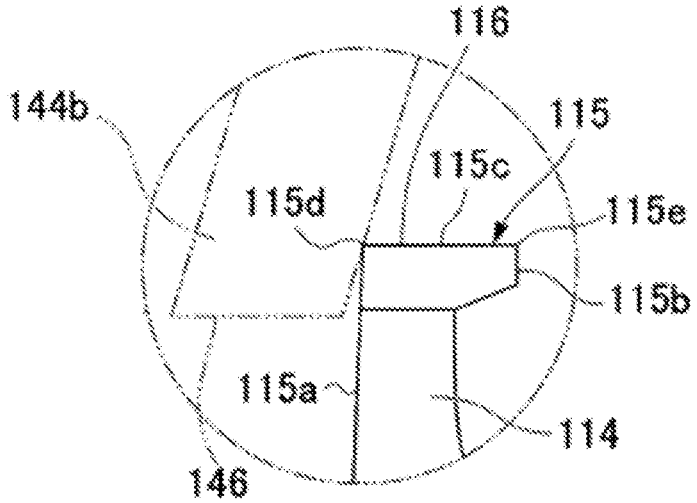
FIG. 2A is an exploded view of a portion of FIG. 2 labeled "A."

In FIG. 2A, the side surface of the tip end portion of the tooth portion 114 is positioned on a far side of the escape wheel & pinion 235 in a rotational direction CW, and includes a stop surface 115*a* against which the nail stones 144*a* and 144*b* abut, a rear surface 115*b* positioned on a near side in the rotational direction CW, and an impact surface 115*c* which is a tip end surface of the tooth portion 114.

A corner portion made by the stop surface 115*a* and the impact surface 115*c* functions as a locking corner 115*d*. A corner portion made by the rear surface 115*b* and the impact surface 115*c* functions as a leaving corner 115*e*.

In the tooth portion 114, a range extending from the stop surface 115*a* to the leaving corner 115*e* through the locking corner 115*d* configures a sliding surface 115. The sliding surface is a surface that can come into contact with another component for a timepiece.

The surface tension of the sliding surface 115 is 10 to 35 mN/m, preferably 11 to 35 mN/m, and more preferably 20 to 30 mN/m. When the surface tension of the sliding surface 115 is equal to or greater than the lower limit value, the affinity with the lubricating oil increases, and when the lubricating oil is applied to the sliding surface 115, high oil holding performance against the lubricating oil is exhibited. Therefore, the lubricating oil is unlikely to flow out from the sliding surface 115. Accordingly, since a state where the lubricating oil exists on the sliding surface 115 is maintained, it becomes possible to suppress deterioration of the escape wheel & pinion 235 due to the abrasion or the like, and to perform a stable operation for a long period of time. When the surface tension of the sliding surface 115 is equal to or less than the upper limit value, the lubricating oil is unlikely to spread wet when the lubricating oil is applied to the sliding surface 115. Accordingly, since the lubricating oil is unlikely to transpire and a state where the lubricating oil exists on the sliding surface 115 is maintained, it becomes possible to suppress deterioration of the escape wheel & pinion 235 due to the abrasion or the like, and to perform a stable operation for a long period of time.

Meanwhile, when vibration is applied to the component for a timepiece, there is a case where the lubricating oil is scattered. In particular, at a part where intermittent engagement, such as an escape mechanism including the escape wheel & pinion and the pallet fork, a calendar mechanism including a date indicator and a date jumper which will be described later, and the like, is repeated, the scattering of the lubricating oil tends to become remarkable.

When the surface tension of the sliding surface 115 is 11 to 35 mN/m, the lubricating oil is unlikely to be scattered even when the vibration is applied to the escape wheel & pinion 235. Accordingly, since the lubricating oil more stably exists on the sliding surface 115, it is possible to more effectively suppress deterioration of the escape wheel & pinion 235 due to abrasion and the like.

The surface tension of the sliding surface 115 is obtained by Zisman plot. Specifically, first, a plurality of test liquids having different surface tensions are dropped onto the sliding surface 115 and form droplets, and a contact angle (θ) between the droplet and the sliding surface 115 is measured to calculate cos θ. Next, the surface tensions of each test liquid are plotted on the lateral shaft and cos θ is plotted on the longitudinal shaft to prepare the Zisman plot, and the value of the surface tension when cos θ=1 on the approximate primary straight line is obtained. A similar operation is performed at five different places of the sliding surface 115 to prepare the Zisman plot, the value of the surface tension when cos θ=1 on the approximate primary straight line, and the average value is defined as the surface tension of the sliding surface 115. In addition, the formation of the droplets and the measurement of the contact angle (θ) are performed at 25° C.

The surface tension of the sliding surface 115 may be the same value or different at all locations of the sliding surface 115 as long as the surface tension is within the above-described range.

As the test liquid, pentane (16.0 mN/m), heptadecane (27.4 mN/m), iodocyclohexane (35.7 mN/m), ethylene glycol (48.4 mN/m), formamide (58.1 mN/m), diiodomethane (66.2 mN/m), glycerin (63.4 mN/m), and distilled water (72.8 mN/m) are used.

In addition, the numerical values in parentheses are the surface tensions at 25° C.

When the lubricating oil having a surface tension of 25 to 35 mN/m at 25° C. is applied to the sliding surface 115, an interfacial tension between the sliding surface 115 and the lubricating oil is preferably 0 to 7 mN/m, more preferably 0 to 5 mN/m, and still more preferably 0.4 to 3 mN/m. A case where the interfacial tension between the sliding surface 115 and the lubricating oil is equal to or less than the upper limit value, means that affinity with the lubricating oil is more excellent, and higher oil holding performance for the lubricating oil is exhibited. Therefore, the lubricating oil is more unlikely to flow out from the sliding surface 115. In addition, the lubricating oil is unlikely to spread wet, and is more unlikely to transpire. Accordingly, since a state where the lubricating oil exists on the sliding surface 115 is more excellently maintained, it becomes possible to suppress deterioration of the escape wheel & pinion 235 due to the abrasion or the like, and to perform a more stable operation for a long period of time. In particular, when the interfacial tension between the sliding surface 115 and the lubricating oil is 0 to 5 mN/m, it is possible to suppress the scattering of the lubricating oil even when the vibration is applied to the escape wheel & pinion 235.

The interfacial tension between the sliding surface 115 and the lubricating oil is obtained by Young's equation. Specifically, first, the lubricating oil is dropped onto the sliding surface 115 and forms droplets, and the contact angle (θ) between the droplet and the sliding surface 115 is measured to calculate cos θ. Separately, the surface tension ($\gamma_s$) of the sliding surface 115 at the location where the lubricating oil was dropped is obtained from the above-described Zisman plot. In addition, the surface tension ($\gamma_L$) of the lubricating oil is obtained by a catalog value or a pendant drop method. Subsequently, cos θ, $\gamma_s$, and $\gamma_L$ are substituted into the Young's equation illustrated in the following equation (i) to obtain the interfacial tension ($\gamma_{LS}$) between the solid and the liquid. A similar operation is performed at five different places of the sliding surface 115 to obtain $\gamma_{LS}$, and the average value thereof is defined as the interfacial tension between the sliding surface 115 and the lubricating oil. In addition, the formation of the droplets and the measurement of the contact angle (θ) are performed at 25° C.

$$\gamma_s=\gamma_{LS}+\gamma_L\cdot\cos(\theta) \quad \text{(i)}$$

(In the equation (i), $\gamma_s$ is the surface tension of the solid (sliding surface 115), $\gamma_{LS}$ is the interfacial tension between the solid and the liquid (the sliding surface 115 and the lubricating oil), $\gamma_L$ is the surface tension of the liquid (lubricating oil), and θ is the contact angle between the solid (sliding surface 115) and the liquid (lubricating oil)).

The interfacial tension between the sliding surface 115 and the lubricating oil may be the same value or different at all locations of the sliding surface 115 as long as the interfacial tension is within the above-described range.

The lubricating oil is not particularly limited as long as the surface tension at 25° C. is within the above-described range and as long as the lubricating oil is a lubricating oil to be used for a timepiece, but for example, aliphatic hydrocarbon oils, such as poly α-olefin (PAO) and polyribs ten; aromatic hydrocarbon oils, such as alkylbenzenes and alkylnaphthalenes; ester oils, such as polyol esters and phosphate esters; ether oils, such as polyphenyl ethers; polyalkylene glycol oils; silicone oils; and fluorine oils, are employed.

In order to set the surface tension of the sliding surface 115 or the interfacial tension between the sliding surface 115 and the lubricating oil within the above-described ranges, for example, a location (treated surface) to be the sliding surface 115 may be treated by using an oil holding treatment agent which will be described later and an oil holding film 116 may be formed.

The surface tension of the escape wheel & pinion 235 at a part other than the sliding surface 115 is not particularly limited, and may be 10 to 35 mN/m or may be out of the range. In addition, the interfacial tension between the surface (non-sliding surface) of the escape wheel & pinion 235 at a part other than the sliding surface 115 and the lubricating oil having the surface tension of 25 to 35 mN/m at 25° C. is not particularly limited, may be 0 to 7 mN/m or may be out of the range. In other words, the oil holding film 116 may be formed on a non-sliding surface of the escape wheel & pinion 235, or the oil holding film 116 may not be formed. In addition, a film having a surface tension less than that of the sliding surface 115 may be formed on the non-sliding surface of the escape wheel & pinion 235, and as such a film, for example, a film (oil repellent film) having a surface tension of less than 10 mN/m is employed.

(Pallet Fork)

As illustrated in FIG. 3, the pallet fork 236 includes a pallet fork body **142*d* and a pallet staff 142*f* which are formed in a T shape by three pallet fork beams 143. The pallet fork body 142*d* is configured to be rotatable by a pallet staff 142*f* which is a shaft. Both ends of the pallet staff 142*f* are rotatably supported with respect to the main plate 211 and a pallet bridge (not illustrated) of the movement 210 illustrated in FIG. 1, respectively. In addition, the rotation range of the pallet fork 236** is restricted by a banking pin (not illustrated).

Nail stones (an inner nail stone **144*a* and an outer nail stone 144*b***) are provided at tip ends of two pallet fork beams 143 of the three pallet fork beams 143, and a double roller (not illustrated) of the balance with the hairspring 240 of the movement 210 illustrated in FIG. 1 and a detachable pallet fork part 145 are attached to a tip end of the remaining pallet fork beam 143. The nail stones (the inner nail stone 144*a* and the outer nail stone 144*b*) are made of ruby formed in a prismatic shape and adhered and fixed to the pallet fork beam 143 by an adhesive or the like.

Figure 3A:
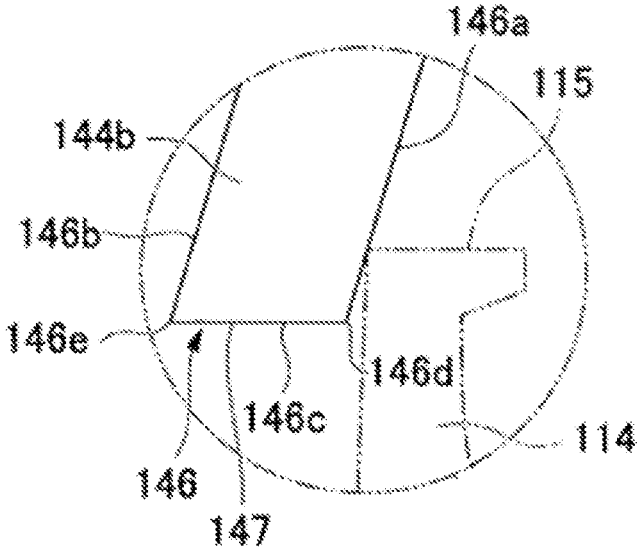
FIG. 3A is an exploded view of a portion of FIG. 3 labeled "A."

In FIG. 3A, the tip end portion of the outer rail stone 144*b* has a stop surface 146*a* which is positioned on the near side in the rotational direction CW of the escape wheel portion 101 illustrated in FIG. 2 and abuts against the stop surface 115*a* of the tooth portion 114, a rear surface 146*b* which is positioned on the far side in the rotational direction CW, and an impact surface 146*c* which is a tip end surface of the outer nail stone 144*b*.

A corner portion made by the stop surface 146*a* and the impact surface 146*c* functions as a locking corner 146*d*. A corner portion made by the rear surface 146*b* and the impact surface 146*c* functions as a leaving corner 146*e*.

In the outer nail stone 144*b*, a range that extends from the stop surface 146*a* to the leaving corner 146*e* through the locking corner 146*d* configures a sliding surface 146.

In addition, since the configuration of the tip end portion of the inner nail stone 144*a* among the nail stones 144*a* and 144*b* is the same as the configuration of the tip end portion of the outer nail stone 144*b*, the description thereof will be omitted.

The surface tension of the sliding surface 146 is 10 to 35 mN/m, preferably 11 to 35 mN/m, and more preferably 20 to 30 mN/m. When the surface tension of the sliding surface 146 is equal to or greater than the lower limit value, the affinity with the lubricating oil increases, and when the lubricating oil is applied to the sliding surface 146, high oil holding performance against the lubricating oil is exhibited. Therefore, the lubricating oil is unlikely to flow out from the sliding surface 146. Accordingly, since a state where the lubricating oil exists on the sliding surface 146 is maintained, it becomes possible to suppress deterioration of the pallet fork 236 due to the abrasion or the like, and to perform a stable operation for a long period of time. When the surface tension of the sliding surface 146 is equal to or less than the upper limit value, the lubricating oil is unlikely to spread wet when the lubricating oil is applied to the sliding surface 146. Accordingly, since the lubricating oil is unlikely to transpire and a state where the lubricating oil exists on the sliding surface 146 is maintained, it becomes possible to suppress deterioration of the pallet fork 236 due to the abrasion or the like, and to perform a stable operation for a long period of time. In particular, when the surface tension of the sliding surface 146 is 11 to 35 mN/m, the lubricating oil is unlikely to be scattered even when the vibration is applied to the pallet fork 236.

The surface tension of the sliding surface 146 is obtained by the Zisman plot. Specifically, the surface tension is obtained in the same manner as the surface tension of the sliding surface of the escape wheel & pinion.

The surface tension of the sliding surface 146 may be the same value or different at all locations of the sliding surface 146 as long as the surface tension is within the above-described range.

When the lubricating oil having a surface tension of 25 to 35 mN/m at 25° C. is applied to the sliding surface 146, an interfacial tension between the sliding surface 146 and the lubricating oil is preferably 0 to 7 mN/m, more preferably 0 to 5 mN/m, and still more preferably 0.4 to 3 mN/m. A case where the interfacial tension between the sliding surface 146 and the lubricating oil is equal to or less than the upper limit value, means that affinity with the lubricating oil is more excellent, higher oil holding performance for the lubricating oil is exhibited. Therefore, the lubricating oil is more unlikely to flow out from the sliding surface 146. In addition, the lubricating oil is unlikely to spread wet, and is more unlikely to transpire. Accordingly, since a state where the lubricating oil exists on the sliding surface 146 is more excellently maintained, it becomes possible to suppress deterioration of the pallet fork 236 due to the abrasion or the like, and to perform a more stable operation for a long period of time. In particular, when the interfacial tension between the sliding surface 146 and the lubricating oil is 0 to 5 mN/m, it is possible to suppress the scattering of the lubricating oil even when the vibration is applied to the pallet fork 236.

The interfacial tension between the sliding surface 146 and the lubricating oil is obtained by the Young's equation. Specifically, the interfacial tension is obtained in the same manner as the interfacial tension between the sliding surface of the escape wheel & pinion and the lubricating oil.

The interfacial tension between the sliding surface 146 and the lubricating oil may be the same value or different at all locations of the sliding surface 146 as long as the interfacial tension is within the above-described range.

In order to set the surface tension of the sliding surface 146 or the interfacial tension between the sliding surface 146 and the lubricating oil within the above-described ranges, for example, a location (treated surface) to be the sliding surface 146 may be treated by using the oil holding treatment agent which will be described later and an oil holding film 147 may be formed.

The surface tension of the pallet fork 236 at a part other than the sliding surface 146 is not particularly limited, and may be 10 to 35 mN/m or may be out of the range. In addition, the interfacial tension between the surface (non-sliding surface) of the pallet fork 236 at a part other than the sliding surface 146 and the lubricating oil having the surface tension of 25 to 35 mN/m at 25° C. is not particularly limited, may be 0 to 7 mN/m or may be out of the range. In other words, the oil holding film 147 may be formed on a non-sliding surface of the pallet fork 236, or the oil holding film 147 may not be formed. In addition, a film having a surface tension less than that of the sliding surface 146 may be formed on the non-sliding surface of the pallet fork 236, and as such a film, for example, a film (oil repellent film) having a surface tension of less than 10 mN/m is employed.

(Oil Holding Film)

The oil holding films 116 and 147 are formed of, for example, a material having surface energy greater than that of the configuration material of the treated surface.

The oil holding films 116 and 147 contain, for example, a compound (hereinafter, also referred to as "compound (1)") represented by the following general formula (1).

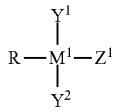

(1)

In the general formula (1), $M^1$ is silicon, titanium, or zirconium, R is a hydrocarbon group, each of $Y^1$ and $Y^2$ independently is a hydrocarbon group, a hydroxy group, or a functional group that generates the hydroxy group by hydrolysis or the like, and $Z^1$ is a polar group.

Examples of the hydrocarbon group include an alkyl group and an aryl group. The hydrocarbon group is preferably an alkyl group. The alkyl group is represented by $C_nH_{2n+1}$ (n is a natural number). n is preferably from 1 to 18, more preferably from 2 to 14, still more preferably from 2 to 10, and particularly preferably from 3 to 6. When n is equal to or greater than the above-described lower limit value, it is possible to enhance the oil holding properties. When n is equal to or less than the above-described upper limit value, it is possible to avoid deterioration of the film quality of the oil holding film due to steric hindrance. In particular, when n is equal to or less than 10, it is possible to shorten the time required for the polymerization reaction.

The "functional group that generates the hydroxy group by hydrolysis or the like" is, for example, an alkoxy group, an aminoxy group, a ketoxime group, an acetoxy group and the like, and one or more of these can be used. The alkoxy group is, for example, a methoxy group, an ethoxy group, a propoxy group and the like, and one or more of these can be used.

The polar group is a functional group having a polarity. The polar group is, for example, a hydroxy group, a carboxy group, a sulfo group, an amino group, a phosphate group, a phosphino group, a silanol group, an epoxy group, an isocyanate group, a cyano group, a vinyl group, a thiol group and the like, and one or more of these can be used.

In the compound (1), the functional group represented by $Z^1$, $Y^1$, and $Y^2$ may be in an aspect in which a part of the configuration elements is lost by bonding. For example, the hydroxy group (—OH) which is $Z^1$ may be in an aspect of "—O—" by bonding with the treated surface by dehydration condensation. The hydroxy group (—OH) which is $Y^1$ and $Y^2$ may be in an aspect of "—O—" by bonding with other $Y^1$ or $Y^2$ by the dehydration condensation. Similarly, the carboxy group (—COOH) may be in an aspect of "—COO—" by bonding.

The content of the compound (1) with respect to the total mass of the oil holding films 116 and 147 is, for example, equal to or greater than 50% by mass.

For example, the polar group of the compound (1) bonds to or adsorbs to a material (for example, an inorganic substance, such as a metal) that configures the treated surface by the dehydration condensation, the hydrogen bonding or the like. The compound (1) can give high oil holding performance to the oil holding films 116 and 147.

As the compound (1), for example, a compound represented by the following general formula (2) can be exemplified.

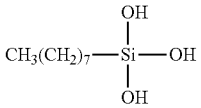

(2)

The compound (1) can be obtained, for example, by hydrolyzing a compound represented by the following general formula (3).

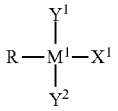

(3)

In the general formula (3), $M^1$ is silicon, titanium, or zirconium, R is a hydrocarbon group, each of $Y^1$ and $Y^2$ independently is a hydrocarbon group, a hydroxy group, or a functional group that generates the hydroxy group by hydrolysis or the like, and $X^1$ is a functional group that generates a hydroxy group by hydrolysis or the like.

As the compound represented by the general formula (3), for example, octyltriethoxysilane (for example, triethoxy-n-octylsilane), triethoxyethylsilane, butyltrimethoxysilane or the like represented by the following general formula (4) can be employed.

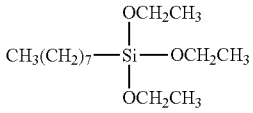

(4)

For forming the oil holding films 116 and 147, for example, the oil holding treatment agent containing an oil holding agent containing the compound (1) and a solvent is used. One type of the compound (1) may be used alone, or two or more types thereof may be used in combination.

The oil holding agent preferably contains at least one of an acid and a base. The acid and the base are not particularly limited as long as the acid and the base accelerate the hydrolysis reaction, but include acids, such as acetic acid, hydrochloric acid, nitric acid, sulfuric acid; and bases, such as sodium hydroxide and potassium hydroxide. The added amount of the acid and the base is, for example, 1 to 20 parts by mass based on 100 parts by mass of the compound (1). An additive (for example, a curing catalyst, such as dibutyltin diaurate or the like) may be added to the oil holding agent. The added amount of the additive to the total mass of the oil holding agent is, for example, 0.001 to 5% by mass.

As the solvent, alcohol, ketone and the like can be used. Alcohols include methanol, ethanol, 1-propanol, isopropyl alcohol, 1-butanol and the like. Ketones include acetone, methyl ethyl ketone and the like. In addition, the oil holding treatment agent may not contain a solvent.

In order to form the oil holding films 116 and 147, the treated surface is coated with the oil holding treatment agent to form a coating film. By drying the coating film and removing the solvent, the oil holding film 116 and 147 are obtained. The surfaces of the oil holding films 116 and 147 are the sliding surfaces 115 and 146. The surface tension of the sliding surfaces 115 and 146 or the interfacial tension between the sliding surfaces 115 and 146 and the lubricating oil can be controlled, for example, by the type or content of the compound (1) in the oil holding films 116 and 147 and the thickness of the oil holding films 116 and 147.

Examples of a coating method for the oil holding treatment agent include a dipping method, a spray coating method, a brush coating method, a curtain coating method, a flow coating method, and the like.

In a case where the oil holding films 116 and 147 contain the compound (1), the thickness of the oil holding films 116 and 147 is preferably 0.1 to 1 μm. When the thickness of the oil holding films 116 and 147 is within the above-described range, it is possible to easily express sufficient oil holding performance without interfering with the functions of the escape wheel & pinion 235 and the pallet fork 236.

The oil holding films 116 and 147 are not limited to the description above, and for example, may contain fluorine compounds.

The fluorine compound is not particularly limited as long as the surface tension of the surface (that is, the sliding surfaces 115 and 146) when the oil holding films 116 and 147 are formed and the interfacial tension between the sliding surfaces 115 and 146 and the lubricating oil are within the above-described range. As such a fluorine compound, a commercially available product can be used, and for example, the product name "HFD-1098" manufactured by Harves Co., Ltd. and the product name "SFE-MS 01" manufactured by AGC Seimi Chemical Co. are employed.

In a case where the oil holding films 116 and 147 contain the fluorine compound, the thickness of the oil holding films 116 and 147 is preferably equal to or greater than 1 nm and less than 100 nm. When the thickness of the oil holding films 116 and 147 is within the above-described range, it is possible to easily express sufficient oil holding performance without interfering with the functions of the escape wheel & pinion 235 and the pallet fork 236.

The surface tension of the sliding surfaces 115 and 146 or the interfacial tension between the sliding surfaces 115 and 146 and the lubricating oil can be controlled, for example, by the type or content of the fluorine compound in the oil holding films 116 and 147 and the thickness of the oil holding films 116 and 147.

Since the escape mechanism 230 which is the component for a timepiece of the present embodiment includes the escape wheel & pinion 235 having the sliding surface 115 having a surface tension of 10 to 35 mN/m and the pallet fork 236 having a sliding surface 146 having a surface tension of 10 to 35 mN/m, the sliding surfaces 115 and 146 exhibit high affinity with the lubricating oil and high oil holding performance for the lubricating oil. Therefore, the lubricating oil is unlikely to flow out from the sliding surfaces 115 and 146. Accordingly, since a state where the lubricating oil exists at the sliding location is maintained, it becomes possible to suppress deterioration of the escape mechanism 230 due to the abrasion or the like, and to perform a stable operation for a long period of time. In particular, when the surface tension of the sliding surfaces 115 and 146 is 11 to 35 mN/m, the lubricating oil is unlikely to be scattered from the sliding location even when the vibration is applied to the escape mechanism 230.

Second Embodiment

The component for a timepiece according to a second embodiment of the present invention will be described with reference to FIG. 4.

Figure 4:
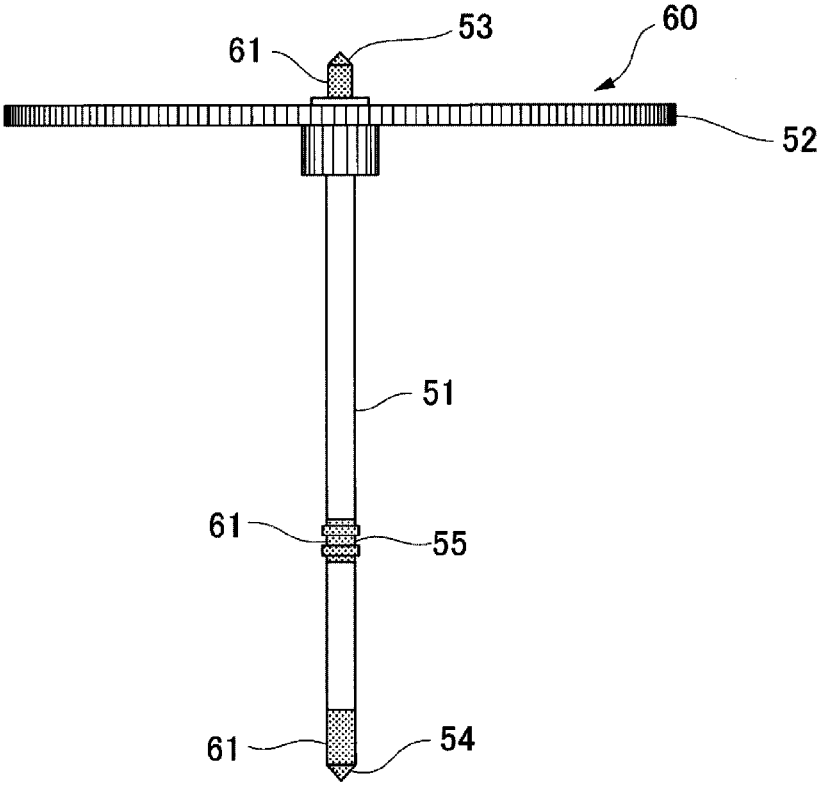
FIG. 4 is a side view illustrating one aspect of a component for a timepiece according to a second embodiment of the present invention.

FIG. 4 is a side view illustrating a wheel 60 which is the component for a timepiece according to the second embodiment of the present invention.

As illustrated in FIG. 4, the wheel 60 includes a shaft portion 51 and a wheel portion 52 fixed to the shaft portion 51.

A first end portion 53 (first tenon portion) and a second end portion 54 (second tenon portion) of the shaft portion 51 are rotatably supported by a bearing (not illustrated). There is a possibility that the outer circumferential surfaces of the first end portion 53 and the second end portion 54 slide against the inner circumferential surface of the bearing. There is a possibility that the outer circumferential surface of an intermediate portion 55 (intermediate portion in the longitudinal direction) of the shaft portion 51 slides against the inner circumferential surface of a cannon pinion (not illustrated). In other words, the outer circumferential surfaces of the first end portion 53, the second end portion 54, and the intermediate portion 55 of the shaft portion 51 are the sliding surfaces of the wheel 60.

The surface tension of the outer circumferential surface (sliding surface) of the first end portion 53, the second end portion 54, and the intermediate portion 55 of the shaft portion 51 is 10 to 35 mN/m, preferably 11 to 35 mN/m, and more preferably 20 to 30 mN/m. When the surface tension of the sliding surface of the wheel 60 is equal to or greater than the lower limit value, the affinity with the lubricating oil increases, and when the lubricating oil is applied to the sliding surface of the wheel 60, high oil holding performance against the lubricating oil is exhibited. Therefore, the lubricating oil is unlikely to flow out from the sliding surface of the wheel 60. Accordingly, since a state where the lubricating oil exists on the sliding surface of the wheel 60 is maintained, it becomes possible to suppress deterioration of the wheel 60 due to the abrasion or the like, and to perform a stable operation for a long period of time. When the surface tension of the sliding surface of the wheel 60 is equal to or less than the upper limit value, the lubricating oil is unlikely to spread wet when the lubricating oil is applied to the sliding surface of the wheel 60. Accordingly, since the lubricating oil is unlikely to transpire and a state where the lubricating oil exists on the sliding surface of the wheel 60 is maintained, it becomes possible to suppress deterioration of the wheel 60 due to the abrasion or the like, and to perform a stable operation for a long period of time. In particular, when the surface tension of the sliding surface of the wheel 60 is 11 to 35 mN/m, the lubricating oil is unlikely to be scattered even when the vibration is applied to the wheel 60.

The surface tension of the sliding surface of the wheel 60 is obtained by the Zisman plot. Specifically, the surface tension is obtained in the same manner as the surface tension of the sliding surface of the escape wheel & pinion, described in the first embodiment.

The surface tension of the sliding surface of the wheel 60 may be the same value or different at all locations of the sliding surface as long as the surface tension is within the above-described range.

When the lubricating oil having a surface tension of 25 to 35 mN/m at 25° C. is applied to the sliding surface of the wheel 60, an interfacial tension between the sliding surface and the lubricating oil is preferably 0 to 7 mN/m, more preferably 0 to 5 mN/m, and still more preferably 0.4 to 3 mN/m. A case where the interfacial tension between the sliding surface of the wheel 60 and the lubricating oil is equal to or less than the upper limit value, means that affinity with the lubricating oil is more excellent, higher oil holding performance for the lubricating oil is exhibited. Therefore, the lubricating oil is more unlikely to flow out from the sliding surface of the wheel 60. In addition, the lubricating oil is unlikely to spread wet, and is more unlikely to transpire. Accordingly, since a state where the lubricating oil exists on the sliding surface of the wheel 60 is more excellently maintained, it becomes possible to suppress deterioration of the wheel 60 due to the abrasion or the like, and to perform a more stable operation for a long period of time. In particular, when the interfacial tension between the sliding surface of the wheel 60 and the lubricating oil is 0 to 5 mN/m, it is possible to suppress the scattering of the lubricating oil even when the vibration is applied to the wheel 60.

The interfacial tension between the sliding surface of the wheel 60 and the lubricating oil is obtained by the Young's equation. Specifically, the interfacial tension is obtained in the same manner as the interfacial tension between the sliding surface of the escape wheel & pinion and the lubricating oil, described in the first embodiment.

The interfacial tension between the sliding surface of the wheel 60 and the lubricating oil may be the same value or different at all locations of the sliding surface as long as the surface tension is within the above-described range.

In order to set the surface tension of the sliding surface of the wheel 60 and the interfacial tension between the sliding surface of the wheel 60 and the lubricating oil within the above-described ranges, for example, oil holding films 61 may be respectively formed at a location (treated surface) to be a sliding surface.

The material or the like of the oil holding film 61 can be the same as the oil holding film in the first embodiment.

The surface tension of the shaft portion 51 at a part other than the sliding surface is not particularly limited, and may be 10 to 35 mN/m or may be out of the range. In addition, the interfacial tension between the outer circumferential surface (non-sliding surface) of the shaft portion 51 at a part other than the sliding surface and the lubricating oil having the surface tension of 25 to 35 mN/m at 25° C. is not particularly limited, may be 0 to 7 mN/m or may be out of the range. In other words, on the non-sliding surface of the shaft portion 51, the oil holding film 61 may be formed or the oil holding film 61 may not be formed. In addition, on the non-sliding surface of the shaft portion 51, a film having a surface tension less than that of the sliding surface of the wheel 60 may be formed, and as such a film, for example, a film (oil repellent film) having a surface tension of less than 10 mN/m is employed.

Since the sliding surface having a surface tension of 10 to 35 mN/m is in the wheel 60 which is the component for a timepiece of the embodiment, the sliding surface exhibits high affinity with the lubricating oil and high oil holding performance for the lubricating oil. Therefore, the lubricating oil is unlikely to flow out from the sliding surface of the wheel 60. Accordingly, since a state where the lubricating oil exists at the sliding location is maintained, it becomes possible to suppress deterioration of the wheel 60 due to the abrasion or the like, and to perform a stable operation for a long period of time. In particular, when the surface tension of the sliding surface of the wheel 60 is 11 to 35 mN/m, the lubricating oil is unlikely to flow out from the sliding location or be scattered even when the vibration is applied to the wheel 60.

In addition, in the movement and the timepiece provided with the component for a timepiece according to the above-described first embodiment, as the movement barrel 222, the second wheel & pinion 225, the third wheel & pinion 226, and the fourth wheel & pinion 227 illustrated in FIG. 1, the wheel 60 in the second embodiment may be used.

Third Embodiment

The component for a timepiece according to a third embodiment of the present invention will be described with reference to FIG. 5.

Figure 5:
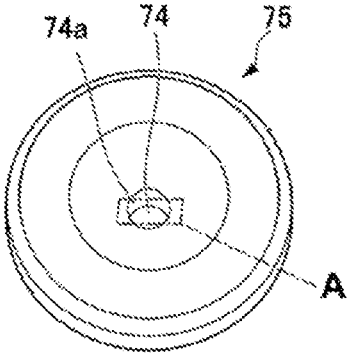
FIG. 5 is a perspective view and a sectional view illustrating a part of a component for a timepiece according to a third embodiment of the present invention.

FIG. 5 is a perspective view and a sectional view illustrating a hole stone 75 which is the component for a timepiece according to the third embodiment of the present invention.

As illustrated in FIG. 5, the hole stone 75 has a circular shape, for example, in a planar view. The hole stone 75 has a through-hole 74. The hole stone 75 is formed of, for example, ruby or the like.

The through-hole 74 is formed to penetrate the hole stone 75 in the thickness direction. The through-hole 74 is formed, for example, at the center of the hole stone 75 in a planar view. The through-hole 74 has a circular shape, for example, in a planar view. In the through-hole 74, for example, a tenon portion of the shaft body is inserted. As the shaft body, for example, the same configuration as the shaft portion 51 of the wheel 60 illustrated in FIG. 4 can be exemplified.

An inner circumferential surface 74*a* of the through-hole 74 of the hole stone 75 is the sliding surface of the hole stone 75.

The surface tension of the inner circumferential surface (sliding surface) 74*a* of the through-hole 74 of the hole stone 75 is 10 to 35 mN/m, preferably 11 to 35 mN/m, and more preferably 20 to 30 mN/m. When the surface tension of the sliding surface of the hole stone 75 is equal to or greater than the lower limit value, the affinity with the lubricating oil increases, and when the lubricating oil is applied to the sliding surface of the hole stone 75, high oil holding performance against the lubricating oil is exhibited. Therefore, the lubricating oil is unlikely to flow out from the sliding surface of the hole stone 75. Accordingly, since a state where the lubricating oil exists on the sliding surface of the hole stone 75 is maintained, it becomes possible to suppress deterioration of the hole stone 75 due to the abrasion or the like, and to perform a stable operation for a long period of time. When the surface tension of the sliding surface of the hole stone 75 is equal to or less than the upper limit value, the lubricating oil is unlikely to spread wet when the lubricating oil is applied to the sliding surface of the hole stone 75. Accordingly, since the lubricating oil is unlikely to transpire and a state where the lubricating oil exists on the sliding surface of the hole stone 75 is maintained, it becomes possible to suppress deterioration of the hole stone 75 due to the abrasion or the like, and to perform a stable operation for a long period of time. In particular, when the surface tension of the sliding surface of the hole stone 75 is 11 to 35 mN/m, the lubricating oil is unlikely to be scattered even when the vibration is applied to the hole stone 75.

The surface tension of the sliding surface of the hole stone 75 is obtained by the Zisman plot. Specifically, the surface tension is obtained in the same manner as the surface tension of the sliding surface of the escape wheel & pinion, described in the first embodiment.

The surface tension of the sliding surface of the hole stone 75 may be the same value or different at all locations of the sliding surface as long as the surface tension is within the above-described range.

When the lubricating oil having a surface tension of 25 to 35 mN/m at 25° C. is applied to the sliding surface of the hole stone 75, an interfacial tension between the sliding surface and the lubricating oil is preferably 0 to 7 mN/m, more preferably 0 to 5 mN/m, and still more preferably 0.4 to 3 mN/m. A case where the interfacial tension between the sliding surface of the hole stone 75 and the lubricating oil is equal to or less than the upper limit value, means that affinity with the lubricating oil is more excellent, higher oil holding performance for the lubricating oil is exhibited. Therefore, the lubricating oil is more unlikely to flow out from the sliding surface of the hole stone 75. In addition, the lubricating oil is unlikely to spread wet, and is more unlikely to transpire. Accordingly, since a state where the lubricating oil exists on the sliding surface of the hole stone 75 is more excellently maintained, it becomes possible to suppress deterioration of the hole stone 75 due to the abrasion or the like, and to perform a stable operation for a long period of time. In particular, when the interfacial tension between the sliding surface of the hole stone 75 and the lubricating oil is 0 to 5 mN/m, it is possible to suppress the scattering of the lubricating oil even when the vibration is applied to the hole stone 75.

The interfacial tension between the sliding surface of the hole stone 75 and the lubricating oil is obtained by the Young's equation. Specifically, the interfacial tension is obtained in the same manner as the interfacial tension between the sliding surface of the escape wheel & pinion and the lubricating oil, described in the first embodiment.

The interfacial tension between the sliding surface of the hole stone 75 and the lubricating oil may be the same value or different at all locations of the sliding surface as long as the interfacial tension is within the above-described range.

In order to set the surface tension of the sliding surface of the hole stone 75 or the interfacial tension between the sliding surface of the hole stone 75 and the lubricating oil within the above-described ranges, for example, oil holding films 71 may be respectively formed at a location (treated surface) to be a sliding surface.

Figure 5A:
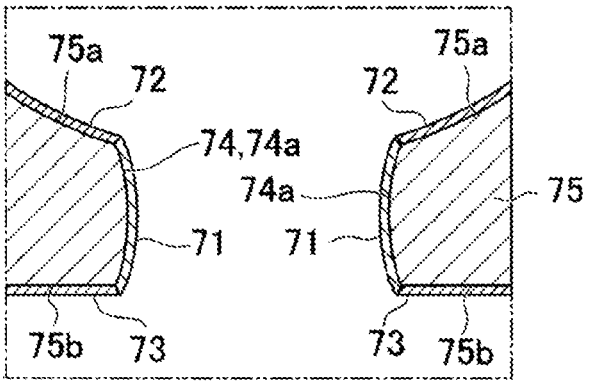
FIG. 5A is an exploded view of a portion of FIG. 5 labeled "A."

In FIG. 5A, the material or the like of the oil holding film 71 can be the same as the oil holding film in the first embodiment.

The surface tension of the hole stone 75 at a part (first surface 75*a* and second surface 75*b*) other than the sliding surface is not particularly limited, and may be 10 to 35 mN/m or may be out of the range. In addition, the interfacial tension between the first surface 75*a* and the second surface 75*b* and the lubricating oil having the surface tension of 25 to 35 mN/m at 25° C. is not particularly limited, may be 0 to 7 mN/m or may be out of the range. In other words, on the first surface 75*a* and the second surface 75*b*, the oil holding film 71 may be formed or the oil holding film 71 may not be formed. In addition, on the first surface 75*a* and the second surface 75*b*, a film having a surface tension less than that of the sliding surface of the hole stone 75 may be formed, and as such a film, for example, as illustrated in FIG. 5, films (oil repellent films) 72 and 73 having a surface tension of less than 10 mN/m are employed.

Since the sliding surface having a surface tension of 10 to 35 mN/m is in the hole stone 75 which is the component for a timepiece of the embodiment, the sliding surface exhibits high affinity with the lubricating oil and high oil holding performance for the lubricating oil. Therefore, the lubricating oil is unlikely to flow out from the sliding surface of the hole stone 75. Accordingly, since a state where the lubricating oil exists at the sliding location is maintained, it becomes possible to suppress deterioration of the hole stone 75 due to the abrasion or the like, and to perform a stable operation for a long period of time. In particular, when the surface tension of the sliding surface of the hole stone 75 is 11 to 35 mN/m, the lubricating oil is unlikely to flow out from the sliding location or be scattered even when the vibration is applied to the hole stone 75.

Other Embodiments

Figure 6:
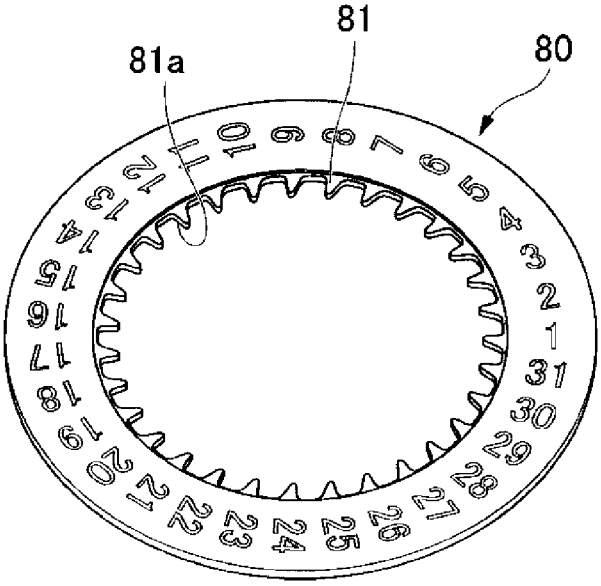
FIG. 6 is a perspective view illustrating one aspect of a component for a timepiece according to another embodiment of the present invention.
Figure 7:
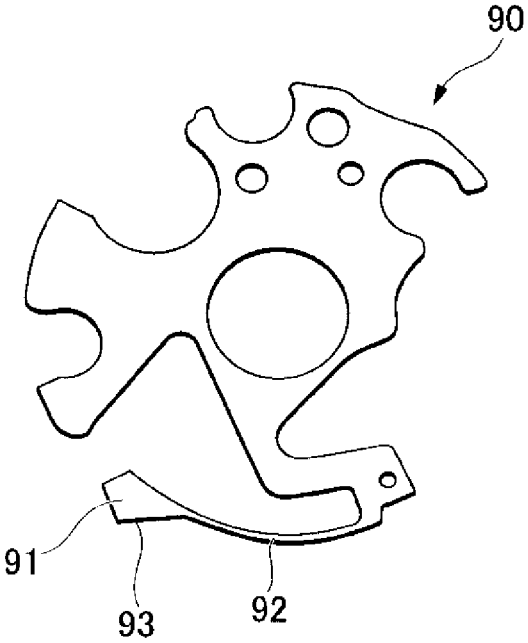
FIG. 7 is a perspective view illustrating one aspect of a component for a timepiece according to another embodiment of the present invention.

The component for a timepiece of the present invention is not limited to the description above, but for example, may be a date indicator 80 illustrated in FIG. 6, a date jumper 90 illustrated in FIG. 7.

In the date indicator 80 illustrated in FIG. 6, in a date indicator tooth portion 81, an engaging surface 81*a* with which an engaging claw portion of the date jumper is engaged is the sliding surface.

The date jumper 90 illustrated in FIG. 7 is a component for correcting the position of the date indicator in the rotational direction, and is provided with an elastically deformable date jumper spring portion 92 of which a tip end portion 91 is a free end. At the tip end portion 91 of the date jumper spring portion 92, an engaging claw portion 93 combinable with the date indicator tooth portion of the date indicator is formed. In the date jumper 90, the surface of the engaging claw portion 93 is a sliding surface.

The surface tension of the engaging surface (sliding surface) 81*a* of the date indicator 80 and the surface (sliding surface) of the engaging claw portion 93 of the date jumper 90 is 10 to 35 mN/m, preferably 11 to 35 mN/m, and more preferably 20 to 30 mN/m.

The surface tension of the sliding surface of the date indicator 80 and the date jumper 90 is obtained by the Zisman plot. Specifically, the surface tension is obtained in the same manner as the surface tension of the sliding surface of the escape wheel & pinion, described in the first embodiment.

The surface tension of the sliding surface of the date indicator 80 and the date jumper 90 may be the same value or different at all locations of the sliding surface as long as the surface tension is within the above-described range.

When the lubricating oil having a surface tension of 25 to 35 mN/m at 25° C. is applied to the sliding surface of the date indicator 80 and the date jumper 90, an interfacial tension between the sliding surface and the lubricating oil is preferably 0 to 7 mN/m, more preferably 0 to 5 mN/m, and still more preferably 0.4 to 3 mN/m.

The interfacial tension between the sliding surface of the date indicator 80 and the date jumper 90 and the lubricating oil is obtained by the Young's equation. Specifically, the interfacial tension is obtained in the same manner as the interfacial tension between the sliding surface of the escape wheel & pinion and the lubricating oil, described in the first embodiment.

The interfacial tension between the sliding surface of the date indicator 80 and the date jumper 90 and the lubricating oil may be the same value or different at all locations of the sliding surface as long as the interfacial tension is within the above-described range.

In order to set the surface tension of the sliding surface of the date indicator 80 and the date jumper 90 or the interfacial tension between the sliding surface of the date indicator 80 and the date jumper 90 and the lubricating oil within the above-described ranges, for example, oil holding films may be respectively formed at a location (treated surface) to be a sliding surface.

The material or the like of the oil holding film can be the same as the oil holding film in the first embodiment.

The surface tension of the date indicator 80 and the date jumper 90 at a part other than the sliding surface is not particularly limited, and may be 10 to 35 mN/m or may be out of the range. In addition, the interfacial tension between the surface (non-sliding surface) of the date indicator 80 and the date jumper 90 at a part other than the sliding surface and the lubricating oil having the surface tension of 25 to 35 mN/m at 25° C. is not particularly limited, may be 0 to 7 mN/m or may be out of the range. In other words, on the non-sliding surface of the date indicator 80 and the date jumper 90, the oil holding film may be formed or the oil holding film may not be formed. In addition, on the non-sliding surface of the date indicator 80 and the date jumper 90, a film having a surface tension less than that of the sliding surface of the date indicator 80 and the date jumper 90 may be formed, and as such a film, for example, a film (oil repellent film) having a surface tension of less than 10 mN/m is employed.

EXAMPLE

Hereinafter, the present invention will be specifically described with reference to Examples, but the present invention is not limited thereto.

Example 1

The oil holding treatment agent was prepared by mixing triethoxyethylsilane (a compound in which $M^1$ is silicon, R is an ethyl group, and $Y^1$, $Y^2$, and $X^1$ are ethoxy groups in the general formula (3)), water, and acetic acid with each other in a molar ratio such that triethoxyethylsilane:water:acetic acid=10:15:1, and by stirring the mixture at 80° C. for 1 hour.

A test piece was obtained in which the oil holding film was formed on a board by coating the board (nickel plated carbon steel) with the obtained oil holding treatment agent such that the thickness after the drying becomes approximately 0.5 μm and by drying the coated board at 150° C. for 1 hour. The surface of the oil holding film is defined as the sliding surface.

The surface tension of the sliding surface and the interfacial tension between the sliding surface and the lubricating oil were measured as follows. The results are illustrated in Table 1.

In addition, the sliding surface was evaluated as follows. The results are illustrated in Table 1.

(Measurement of Surface Tension)

The surface tension of the sliding surface was obtained by the Zisman plot.

First, a plurality of test liquids having different surface tensions were dropped onto the sliding surface and formed the droplets, and the contact angle (θ) between the droplet and the sliding surface was measured to calculate cos θ. Next, the surface tensions of each test liquid were plotted on the lateral shaft and cos θ was plotted on the longitudinal shaft to prepare the Zisman plot, and the value of the surface tension when cos θ=1 on the approximate primary straight line was obtained. A similar operation was performed at five different places of the sliding surface to prepare the Zisman plot, the value of the surface tension when cos θ=1 on the approximate primary straight line, and the average value was defined as the surface tension of the sliding surface. In addition, the formation of the droplets and the measurement of the contact angle (θ) were performed at 25° C.

As the test liquid, pentane, heptadecane, iodocyclohexane, ethylene glycol, formamide, diiodomethane, glycerin, and distilled water were used.

(Measurement of Interfacial Tension)

The interfacial tension between the sliding surface and the lubricating oil was obtained by the Young's equation.

First, the lubricating oil was dropped onto the sliding surface and formed droplets, and the contact angle (θ) between the droplet and the sliding surface was measured to calculate cos θ. Separately, the surface tension ($\gamma_s$) of the sliding surface at the location where the lubricating oil was dropped was obtained from the above-described Zisman plot. In addition, the surface tension ($\gamma_L$) of the lubricating oil was obtained by a catalog value or a pendant drop method. Subsequently, cos θ, $\gamma_s$, and $\gamma_L$ were substituted into the Young's equation illustrated in the following equation (i) to obtain the interfacial tension ($\gamma_{LS}$) between the solid and the liquid. A similar operation was performed at five different places of the sliding surface to obtain $\gamma_{LS}$, and the average value thereof was defined as the interfacial tension between the sliding surface and the lubricating oil. In addition, the formation of the droplets and the measurement of the contact angle (θ) were performed at 25° C.

$$\gamma_s=\gamma_{LS}+\gamma_L\cdot\cos\theta \quad \text{(i)}$$

As the lubricating oil, AO-3 (manufactured by Citizen Watch Co., Ltd., product name "AO-3", surface tension at 25° C.: 30.5 mN/m) or M-A (manufactured by Moebius, product name "SYNT-A-LUBE", surface tension at 25° C.: 32.7 mN/m) were used.

(Evaluation)

In a state where the sliding surface of the test piece is horizontal, the lubricating oil was dropped on the sliding surface. Next, the state of the lubricating oil when the test piece gradually stood up such that the sliding surface was perpendicular to the horizon was visually checked and evaluated according to the following evaluation criteria.

○: The lubricating oil does not drip even when the test piece stands vertically, and the lubricating oil is held on the sliding surface even when the test piece is vibrated.

Δ: The lubricating oil does not drip even when the test piece stands vertically, but the lubricating oil slides down when the test piece is vibrated.

X: The lubricating oil spreads wet when the lubricating oil is dropped on the sliding surface, or the lubricating oil easily slides down when the test piece stands vertically.

Example 2

The oil holding treatment agent was prepared by mixing triethoxy-n-octylsilane (a compound expressed in the general formula (4)), water, and acetic acid with each other in a molar ratio such that triethoxy-n-octylsilane:water:acetic acid=10:15:1, and by stirring the mixture at 80° C. for 8 hours.

A test piece was obtained in which the oil holding film was formed on a board by coating the board (nickel plated carbon steel) with the obtained oil holding treatment agent such that the thickness after the drying becomes approximately 0.5 μm and by drying the coated board at 150° C. for 3 hours. The surface of the oil holding film is defined as the sliding surface.

The surface tension of the sliding surface and the interfacial tension between the sliding surface and the lubricating oil were measured similar to Example 1. In addition, the sliding surface was evaluated similar to Example 1. The results are illustrated in Table 1.

Example 3

The oil holding treatment agent was prepared by mixing butyltrimethoxysilane (a compound in which $M^1$ is silicon, R is a butyl group, and $Y^1$, $Y^2$, and $X^1$ are methoxy group in the general formula (3)), water, and acetic acid with each other in a molar ratio such that butyltrimethoxysilane:water:acetic acid=10:15:1, and by stirring the mixture at 80° C. for 1 hour.

A test piece was obtained in which the oil holding film was formed on a board by coating the board (nickel plated carbon steel) with the obtained oil holding treatment agent such that the thickness after the drying becomes approximately 0.5 μm and by drying the coated board at 150° C. for 1 hour. The surface of the oil holding film is defined as the sliding surface.

The surface tension of the sliding surface and the interfacial tension between the sliding surface and the lubricating oil were measured similar to Example 1. In addition, the sliding surface was evaluated similar to Example 1. The results are illustrated in Table 1.

Example 4

A test piece was obtained in which the oil repellent film was formed on a board by coating the board (nickel plated carbon steel) with the fluorine-based treatment agent (manufactured by Harves Co., Ltd., product name: "HFD-1098") such that the thickness after the drying becomes approximately 30 nm and by drying the coated board at 100° C. for 30 minutes. The surface of the oil repellent film is defined as the sliding surface.

The surface tension of the sliding surface and the interfacial tension between the sliding surface and the lubricating oil were measured similar to Example 1. In addition, the sliding surface was evaluated similar to Example 1. The results are illustrated in Table 1.

Example 5

A test piece was obtained in which the oil repellent film was formed on a board by coating the board (nickel plated carbon steel) with a fluorine-based treatment agent (manufactured by AGC Seimi Chemical Co., Ltd., product name: "SFE-MS01", a solution diluted by 600 times of SFE Solvent) such that the thickness after the drying becomes approximately 5 nm and by drying the coated board for 30 minutes at 100° C. The surface of the oil repellent film is defined as the sliding surface.

The surface tension of the sliding surface and the interfacial tension between the sliding surface and the lubricating oil were measured similar to Example 1. In addition, the sliding surface was evaluated similar to Example 1. The results are illustrated in Table 1.

Comparative Example 1

The surface tension of the sliding surface and the interfacial tension between the sliding surface and the lubricating oil were measured similar to Example 1 while the surface of the board (nickel plated carbon steel) is the sliding surface. In addition, the sliding surface was evaluated similar to Example 1. The results are illustrated in Table 1.

Comparative Example 2

A test piece was obtained in which the oil repellent film was formed on a board by vacuum-depositing polytetrafluoroethylene with respect to the board (nickel plated carbon steel) such that the thickness after the deposition becomes approximately 5 nm. The surface of the oil repellent film is defined as the sliding surface.

The surface tension of the sliding surface and the interfacial tension between the sliding surface and the lubricating oil were measured similar to Example 1. In addition, the sliding surface was evaluated similar to Example 1. The results are illustrated in Table 1.

TABLE 1

| | Surface tension of sliding surface [mN/m] | Lubricating oil | Interfacial tension between sliding surface and lubricating oil [mN/m] | Evaluation |
|---|---|---|---|---|
| Example 1 | 29.3 | A0-3 | 2.9 | ○ |
| Example 2 | 25.5 | A0-3 | 1.7 | ○ |
| Example 3 | 24.1 | A0-3 | 0.4 | ○ |
| Example 4 | 10.8 | A0-3 | 6.9 | Δ |
| Example 5 | 10.4 | A0-3 | 6.8 | Δ |
| Comparative Example 1 | 40.0 | A0-3 | 10.2 | X |
| | | M-A | 8.8 | X |
| Comparative Example 2 | 8.0 | A0-3 | 33.0 | X |

As is apparent from Table 1, in each Example, the lubricating oil did not drip even when the test piece stood vertically, and the performance of holding the lubricating oil was excellent. In particular, in cases of Examples 1 to 3, the lubricating oil was unlikely to be scattered even when the vibration is applied to the test piece, and the lubricating oil was more excellent in performance of holding the lubricating oil.

On the contrary, in a case of Comparative Example 1 in which the surface tension of the sliding surface exceeds 35 mN/m, the lubricating oil was likely to spread wet when the lubricating oil was dropped on the sliding surface. In addition, when the test piece stood vertically, the lubricating oil easily slid down.

In a case of Comparative Example 2 in which the surface tension of the sliding surface was less than 10 mN/m, the lubricating oil easily slid down when the test piece stood vertically.

What is claimed is:

1. A component for a timepiece, comprising a sliding surface having a surface tension of 10 to 35 mN/m, wherein the sliding surface comprises an oil holding film comprising a compound represented by the formula (1):

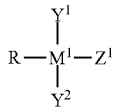

(1)

wherein $M^1$ is silicon, titanium, or zirconium;

R is a hydrocarbon group;

each of $Y^1$ and $Y^2$ independently is a hydrocarbon group, a hydroxy group, or a functional group that generates the hydroxy group by hydrolysis; and $Z^1$ is a polar group.

2. The component for a timepiece according to claim 1, wherein, when a lubricating oil having a surface tension of 25 to 35 mN/m is applied to the sliding surface, an interfacial tension between the sliding surface and the lubricating oil is 0 to 7 mN/m.

3. A movement comprising the component for a time piece according to claim 1.

4. A timepiece comprising the movement according to claim 3.

5. The component for a timepiece according to claim 1, wherein the compound is selected from the group consisting of:

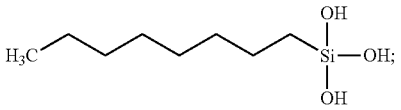
trihydroxyoctylsilane
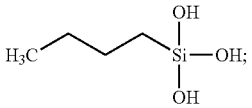
and
trihydroxybutylsilane
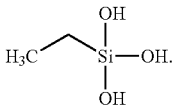
trihydroxyethylsilane
* * * * *